US005152346A

United States Patent [19]

Wilson

[11] Patent Number: 5,152,346

[45] Date of Patent: Oct. 6, 1992

[54] METHOD AND APPARATUS FOR EXTINGUISHING OIL OR GAS WELL FIRES

[76] Inventor: Cary L. Wilson, 5408 E. 11th St., Suite B, Tulsa, Okla. 74112

[21] Appl. No.: 686,665

[22] Filed: Apr. 17, 1991

[51] Int. Cl.[5] ..... A62C 3/06

[52] U.S. Cl. ..... 169/52; 169/48; 169/69

[58] Field of Search ..... 169/69, 43, 46, 52, 169/48

[56] References Cited

U.S. PATENT DOCUMENTS

| | | | |
|---|---|---|---|
| 1,807,498 | 5/1931 | Teed | 169/69 X |
| 1,857,788 | 5/1932 | Murphy | 169/69 X |
| 1,859,606 | 5/1932 | Sievern et al. | 169/69 X |
| 3,887,011 | 6/1975 | Dokes et al. | 169/69 |
| 4,323,118 | 4/1982 | Bergmann | 169/69 X |

*Primary Examiner*—Margaret A. Focarino
*Assistant Examiner*—Andrew C. Pike
*Attorney, Agent, or Firm*—Head & Johnson

[57] ABSTRACT

A method and apparatus extinguishes an oil well or gas well fire burning as a consequence of ignited oil and/or gas escaping the well. The method employs an elevated chimney that is placed over the burning well to cause combustion to shift from the well to an elevated position above the well at the top of the chimney as oil and/or gas continue to escape from the well through the chimney. This provides a route for the passage of unignited oil and/or gas from a lower portion of the chimney. The unignited oil and/or gas can be conducted away from the well while oil and/or gas escaping from the top of the chimney continues to burn. The fire is extinguished by closing off the top of the chimney while permitting all of the oil and/or gas escaping from the well to be routed away from the well in unignited condition through the power portion of the chimney. After the fire is extinguished, the chimney can be removed to permit the well to be closed against further escape of oil and/or gas.

8 Claims, 4 Drawing Sheets

METHOD AND APPARATUS FOR EXTINGUISHING OIL OR GAS WELL FIRES

SUMMARY OF THE INVENTION

Since the beginning of the petroleum industry oil and gas well fires have been a continuous problem. The industry has learned to provide blow-out preventers for closing a well against uncontrolled escape of oil and/or gas during the drilling operation and, therefore, oil and gas well fires are not as common as in the early days of drilling. However, oil and gas well fires continue to occur since escaping oil and/or gas is easily ignited by a single spark and once ignited produces substantial heat to thereby make further effort to close off the well extremely difficult, as well as being hazardous.

The most common method for controlling an oil and/or gas well fire is to use explosives to extinguish the fire. When explosives are used the possibility of re-ignition is reduced by spraying the well site with large volumes of water. Others have provided systems that employ large amounts of carbon dioxide or other gases that serve to snuff out combustion.

A serious problem exists with the use of explosives and other standard techniques in areas of the world where large quantities of water are not readily available or where providing the necessary quantities of non-combustible gas to a system extinguishing a fire is difficult to obtain.

An object of the present invention is to provide a method and apparatus for extinguishing an oil well or a gas well fire in a manner that does not use explosives and wherein the use of large quantities of water or inert gas is not required. Specifically, an object of this invention is to provide a method and apparatus for extinguishing an oil and gas well fire expeditiously and in a manner which does not involve the hazards of use of explosives and wherein a single apparatus may be used repeatedly for extinguishing fires from a plurality of burning oil wells.

For background reference to other apparatuses for extinguishing oil wells, reference may be had to the following previously issued U.S. Pat. Nos. 3,887,011; 4,323,118; 4,323,118; 4,337,831; 4,367,889; and 4,899,827.

SUMMARY OF THE INVENTION

This invention provides a method of extinguishing an oil or gas well fire burning as a consequence of ignited oil and/or gas escaping the well. Usually a flowing well has, at the top of the well casing, a wellhead structure sometimes referred to as a "christmas tree" that controls the flow of oil and/or gas through the well. In some instances this structure is present during a fire or a fire may originate during drilling operations and before any wellhead structure or other apparatus is affixed to the well casing.

In practicing the method of this invention the first step is placing an elevated chimney over the burning well to cause combustion of escaping oil and/or gas to shift from the well to an elevated position above the well at the top of the chimney. The chimney does not interfere with the escape of oil and/or gas from the well and is not intended to function as a high pressure retaining apparatus but is used in such a way that the differential pressure between the interior and exterior of the chimney is low throughout the method of using the chimney.

When the chimney is placed over the well the escaping oil and/or gas continues to escape out of the top of the chimney to thereby shift the combustion from the top of the well to an elevated position at the top of the chimney.

The next step is providing a route for the passage of unignited oil and/or gas from the lower portion of the interior of the chimney, to thereby conduct unignited oil and/or gas away from the well while permitting oil and/or gas to continue to escape from the top of the chimney. The oil and/or gas escaping from the top of the chimney continues to burn as a consequence of the combustion taking place.

After providing a route for the passage of unignited oil and/or gas from the lower portion of the chimney, the top of the chimney is closed thereby closing off the source of oil and/or gas supporting the combustion, and all of the escaping oil and/or gas is routed away from the lower portion of the chimney in unignited condition. This is accomplished without significantly increasing the pressure of oil and/or gas within the interior of the chimney. After combustion has been terminated and the escaping oil and/or gas is conducted by one or more conduits from the lower portion of the interior of the chimney to a safe distance away from the well site and all areas of the well site have been cooled, the chimney can be removed to thereby allow the oil and/or gas to continue to escape in unignited condition and to permit the well to be closed against further oil or gas flow.

The apparatus for practicing the method of this invention includes the use of an elongated generally vertical chimney member having a top and a bottom end and a sidewall. The sidewall has at least one vent opening therein.

A top valve is provided for selectably opening and closing the chimney top end. A vent conduit for each vent opening is provided, each vent conduit having an inlet end and an outlet end and having the inlet end in communication with the chimney vent opening. Each vent conduit extends laterally away from the chimney member a distance necessary to conduit unignited oil and/or gas away from the burning well.

A vent valve is connected in series with each vent conduit for selectively opening and closing the vent conduit.

The chimney member bottom end is of sufficient size to permit the chimney member to be set down vertically over a burning well to cause escaping oil and/or gas to pass upwardly therethrough and out of the top valve so that the combustion of oil and/or gas takes place above the top valve. After combustion is caused to be transferred from the top of the oil and gas well to the top of the chimney to the open top valve, the vent valve or valves are opened to permit unignited oil and/or gas to escape from within the chimney member through each of the vent conduits. After flow of unignited oil and/or gas through the vent conduits is established, the top valve may be closed to extinguish the combustion of oil and/or gas. After combustion is extinguished and areas around the well have cooled, the chimney member is removed to thereby expose the well having escaped oil and/or gas to be capped.

A better understanding of the invention will be obtained by reference to the following description of the preferred embodiment and the attached drawings.

DESCRIPTION OF THE DRAWINGS

FIG. 7 shows a burning well site and shows the apparatus of this invention supported by a boom extending from a mobile vehicle, the equipment being supported above the earth as the vehicle approaches the burning well site.

FIG. 8 shows the chimney apparatus set down over the burning well to cause the combustion to transfer from the top of the well to the top of the chimney and which thereafter permits opening of vent valves to permit unignited oil and/or gas to escape from the lower portion of the chimney.

FIG. 9 shows the top valve having been closed to extinguish the combustion, with all of the escaping oil and/or gas flowing in unignited condition through the vent conduits. FIG. 9 shows the well fire having been extinguished. Thereafter the chimney member may be removed to permit the well to be capped.

DESCRIPTION OF THE PREFERRED EMBODIMENTS

Figure 1:
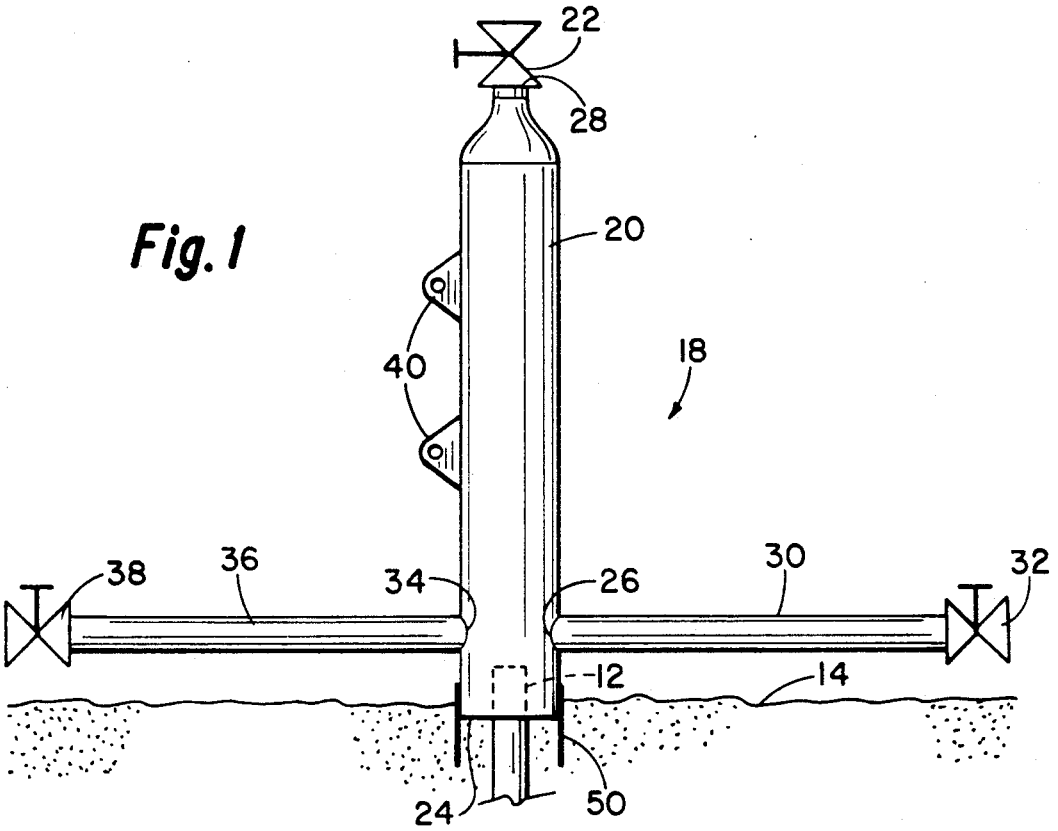
FIG. 1 is an elevational view of the apparatus for practicing the method of this invention and shows a chimney member having a top valve, the chimney having vent openings in the lower portion thereof and vent conduits extending away from the chimney lower portion, each of the vent conduits being controlled by a valve.

Referring to the drawings and first to FIGS. 7, 8, and 9, the method of practicing the invention will be first described and then the apparatus which is used in the method will be described in detail.

Figure 7:
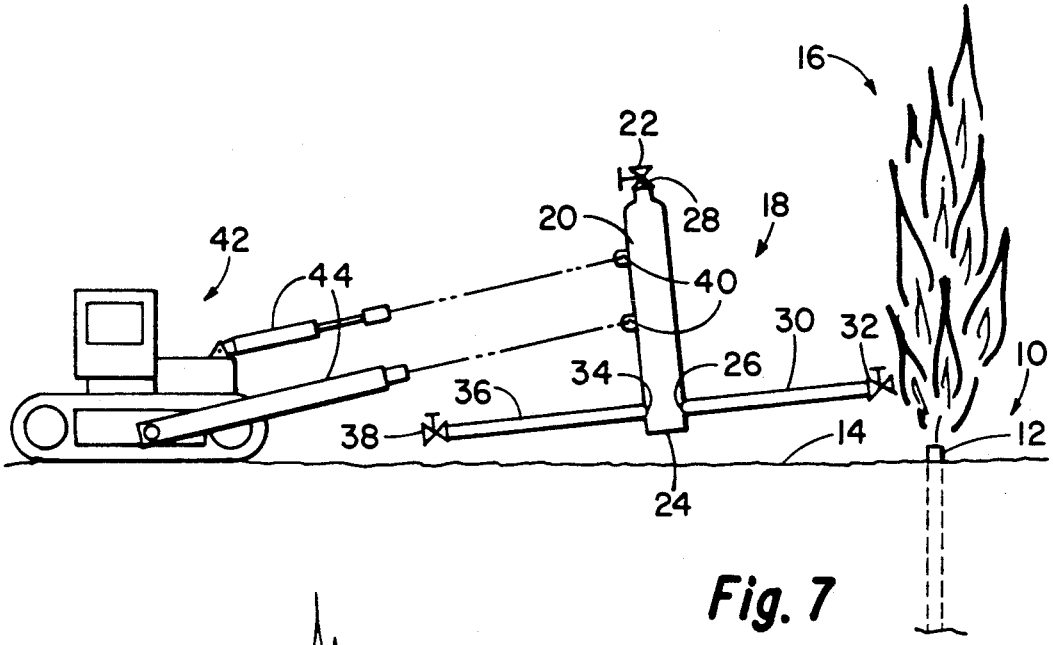
FIGS. 7, 8, and 9 show diagrammatically the sequence of extinguishing an oil and/or gas well fire using the methods and apparatus of this disclosure.

FIG. 7 shows a burning well generally indicated by the numeral 10. The well 10 has a casing 12 extending below the earth's surface 14 by which combustible oil and/or gas is conveyed from a subsurface formation to the earth's surface 14. Normally, if the burning well 10 has been completed there will be, at the top of casing 14, wellhead equipment, which is not shown. During the drilling of a well drilling equipment, not shown, may be around the well site. If escaping oil and/or gas occurs then such equipment, if it exists, in practicing the method of this invention, is removed as far as practically possible from around the well site.

The escaping oil and/or gas, once ignited, continues to burn. Unless the flame, indicated by the numeral 16, is extinguished it is impossible for workmen to approach the well to cap casing 12 and to terminate uncontrolled flow of oil and/or gas from the well. Therefore, when a burning well 10 is encounter the first goal is to extinguish the combustion and thereafter the well can be capped so that the highly valuable oil and/or gas can be conducted away in pipelines for use.

In practicing the method of this invention, an apparatus, generally indicated by the numeral 18, is employed which will be described in detail subsequently. Generally speaking, apparatus 18 includes a chimney member 20 having a top closeable by a top valve 22. The chimney has a bottom 24 that is open. In addition, the chimney has at least one vent opening 26 positioned in the lower portion of the chimney, that is, below the chimney top 28 having valve 22 thereat. Communicating with vent opening 26 is a vent conduit 30. The vent conduit 30 is controlled by a vent valve 32.

The number of vents, vent conduits, and valves may vary. In FIG. 7, for purposes of illustration, chimney member 20 has a second vent opening 34 with a second vent conduit 36 and a second vent valve 38 attached in communication with the opening.

The chimney member has attachment means 40 by which apparatus 18 is moved about. This can be accomplished from a vehicle 42 that can be a dozer or other type of equipment capable of moving on the earth's surface 14 in sandy, muddy, or other unprepared areas. Extending from vehicle 42 are boom members 44 that extend outwardly to engage attachment means 40. Thus, apparatus 18 is transportable at the end of a boom from a vehicle 42. The length of boom members 44 must be such that the operator of the vehicle and the heat sensitive components of the vehicle are sufficiently spaced from burning well 10 to provide safety for the operator and immunity from damage to the vehicle.

Figure 8:
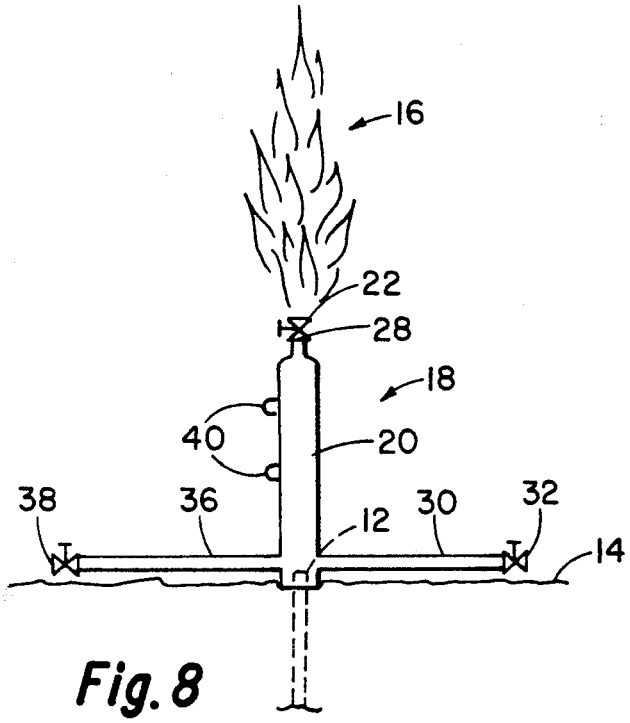

FIG. 8 shows apparatus 18 set down so that chimney member 20 extends over oil well casing 12. When positioned over burning well 10 top valve 22 is fully opened, while vent valves 32 and 38 are closed. The bottom 24 of the chimney member seals against earth's surface 14 so that the escaping oil and/or gas passes upwardly within chimney member 20 and out of open top 28 through open valve 22. In this arrangement, no oxygen, or at least insufficient oxygen, is available within the interior of chimney member 20 so that the fire of the burning oil and/or gas is transferred upwardly to the top of the chimney member, that is, flame 16 continues to burn but it burns above chimney member 20 where oxygen from the atmosphere is freely available. Thus, setting chimney member 20 down over casing 12 serves to elevationally displace burning flame 16.

The chimney member 20 is not intended to function as a pressure vessel, that is, the pressure differential between the interior and the exterior of the chimney member does not substantially increase during the use of apparatus 18. For this purpose, valve 22 must, when opened, present a large diameter opening so that the escaping oil and/or gas from casing 12 freely passes out of the top of the chimney. In this manner, the weight of the chimney member with vent conduits 30 and 36 is such as to hold the chimney member in place over the burning well, and the purpose of the chimney member is to vertically upwardly displace flame 16.

Figure 9:
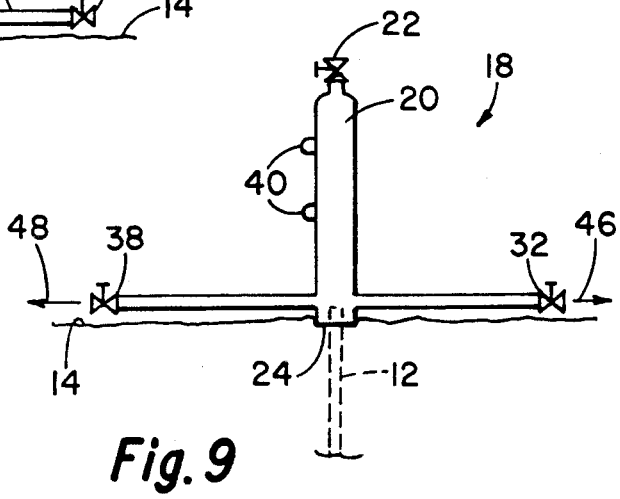

After apparatus 18 is positioned over burning well 10 and flame 16 has been upwardly vertically displaced as shown in FIG. 8, vent valves 32 and 38 are opened so as to permit unignited oil and/or gas to flow through vent conduits 30 and 36 and vent valves 32 and 38, as indicated by the arrows 46 and 48 in FIG. 9. The unignited oil and/or gas flowing out of the vent valves is indicated by the numerals 46 and 48 and is conducted a safe distance away from the burning oil and/or gas well and, specifically, from casing 12 so that such unignited oil and/or gas is not burned but merely accumulates at a safe distance away from the burning well.

When vent valves 32 and 38 are opened, providing alternate flow passage for the escaping oil and/or gas, the quantity escaping through top valve 22 decreases and top valve 22 is then closed. When this happens, flame 16 is extinguished since no further fuel is provided at the location of the flame for sustaining combustion. Once top valve 22 is closed and all gas and/or oil from the well flows through the opened vent valves 32 and 38 the well is no longer aflame but, of course, is still discharging oil and/or gas at unabated volume. The volume is unabated since apparatus 18 does not impose a restriction to flow rate but merely functions to rechannel the direction of flow of the escaping oil and/or gas.

After valve 22 has been closed and all flow from the well is taking place through open vent valves 32 and 38 a period is allowed for all aspects for the fire to abate, that is, where no hot metal or other burning debris remains around the well. Thereafter apparatus 18 may be lifted away from the well. When apparatus 18 is removed the same quantity of oil and/or gas escapes as before, but such is not aflame and workmen may then approach the well to plug the well or close off the wellhead apparatus, if it exists, so as to close in the well and stop the uncontrolled discharge of oil and/or gas. The apparatus 18 is lifted off by reattaching boom members 44 from vehicle 42, and the apparatus is then ready to be used for extinguishing another burning well.

The method of this invention does not involve the need for water or inert gas to effect extinction of the flame or the burning well nor does it require explosives. The apparatus 18 can function to terminate the burning well without the need for water, inert gas, explosives, or any ancillary liquids or gases.

Referring now to FIGS. 1–6, more details of apparatus 18 in various embodiments will be described. FIG. 1 shows the apparatus as previously described with reference to FIGS. 7–9 in greater detail. To effect a vertical displacement of the flame from the escaping well, it is important that the combustion be transferred from the top of casing 12 to above top valve 22—that is, combustion cannot take place within the interior of chimney member 20. Therefore, it is important that the omission of air into the chimney be eliminated or at least substantially restricted to a level that would not support combustion. For this reason, a skirt 50 may be affixed to the chimney member around the bottom 24. The skirt 50 is intended to settle into earth's surface 14 when apparatus 18 is lowered into position over casing 12. Skirt 50 may be of a strong relatively thin metal welded to the exterior surface of the bottom portion of chimney member 20.

In FIG. 1 only two vent openings 26, 34 are shown with connecting vent conduits 30 and 36. Obviously, four, six or any number of such vent openings and vent conduits may be employed and radially extend from chimney member 20. The number of vent openings and vent conduits must be such as to permit, when top valve 22 is closed, the free escape of oil and/or gas from the interior of the chimney member without substantial pressure buildup within the chimney member since if great pressure builds up the chimney member would be upwardly displaced by such pressure. Therefore, in designing the apparatus 18 the need to maintain low differential pressure between the interior and the exterior of the chimney member is an important consideration.

Figure 2:
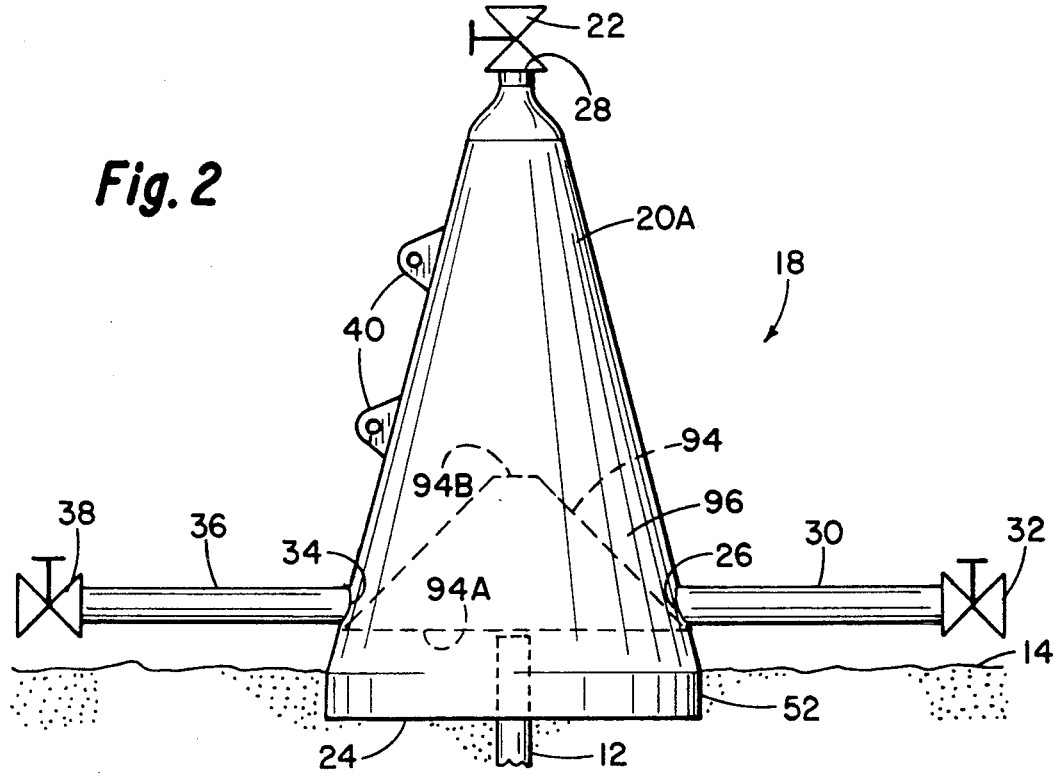
FIG. 2 is an alternate embodiment of FIG. 1 wherein the chimney member is of generally frustoconical configuration, being much larger at the bottom so as to accommodate a well having an apparatus around the bottom of the head, such as a wellhead, that must be encompassed within the chimney in order to practice the invention.

FIG. 2 shows an alternate embodiment of FIG. 1. The only basic difference is that in FIG. 1 chimney member 20 is illustrated as being substantially cylindrical, whereas in FIG. 2 the chimney member 20A is frustoconical, that is, the sidewall of the chimney member 20A is frustoconical. In the arrangement illustrated in FIG. 2 the sidewall of the chimney member includes a lower cylindrical portion 52 that is intended to penetrate within earth's surface 14 so as to limit the passage of air into the interior of the chimney member.

The advantage of FIG. 2 is that it provides a wide area at the bottom of the chimney member that is sufficient to encompass a wellhead or christmas tree apparatus that is typically attached to the upper end of casing 12 of a completed well. The apparatus of FIG. 2 is used in exactly the same way as that described with reference to FIGS. 1 through 9.

Figure 3:
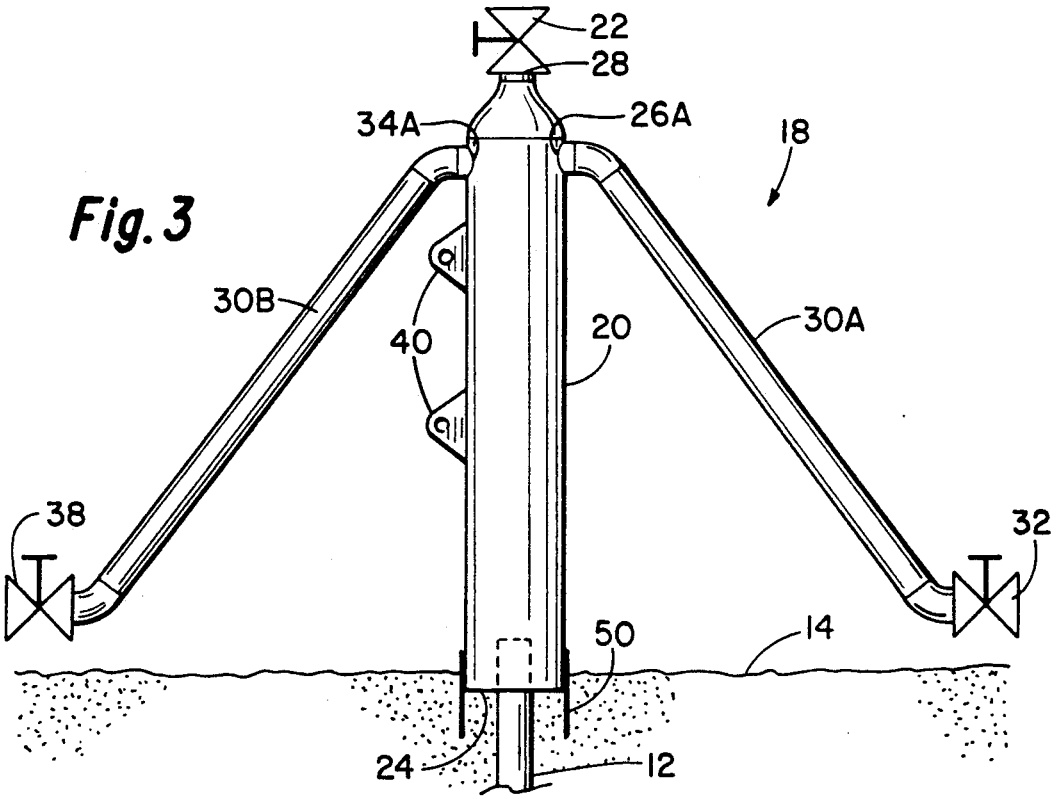
FIG. 3 is an alternate embodiment of FIG. 1 wherein the vent openings through the interior of the chimney are at the top of the chimney and with the vent conduits extending downwardly to adjacent the earth's surface.

FIG. 3 shows an alternate embodiment of the arrangement of the FIG. 1 wherein the vent openings 26A and 34A are spaced adjacent the top of chimney member 20 but below chimney top 28 and below top valve 22. The vent conduits 30A and 30B extend downwardly at an angle to adjacent the earth's surface 14 so that vent valves 32 and 38 are conveniently operated. The embodiment of FIG. 3 functions in exactly the same way as that of FIGS. 1 and 2.

Figure 4:
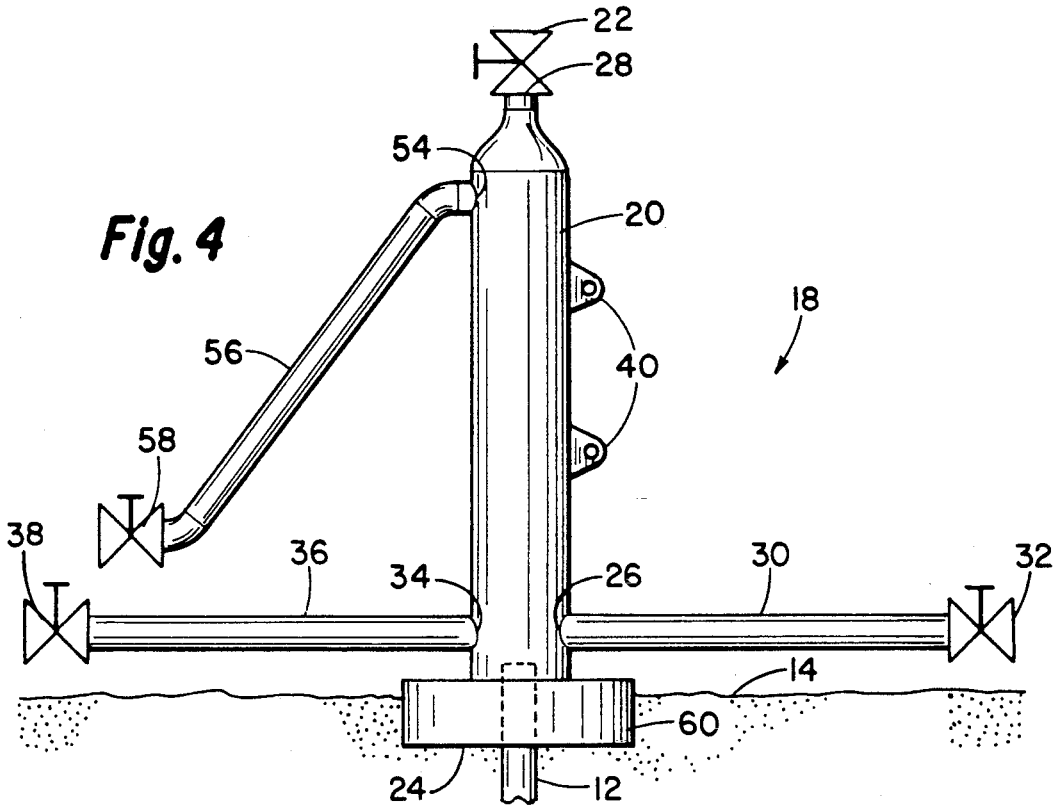
FIG. 4 is another alternate embodiment wherein the chimney member has an enlarged bottom portion for encompassing wellhead equipment and wherein the vent conduits extend from both the lower portion of the chimney and the upper portion of the chimney.

FIG. 4 shows an embodiment that is a combination of the arrangement of FIGS. 1 and 3. That is, in addition to vent openings 26 and 34 with attached vent conduits 30 and 36, a third vent opening 54 is formed in chimney member 20 adjacent and below chimney top 28. A third vent conduit 56 communicates with vent opening 54 and extends downwardly to adjacent the earth's surface 14 and has, affixed to the outer end thereof, a third vent valve 58. The third vent valve 58 is opened and closed in conjunction with opening and closing vent valves 32 and 38 to discharge the escaping oil and/or gas from the well to a safe distance away from the well after the flame of the burning oil and/or gas has been elevationally moved upwardly to above top valve 22.

While FIG. 4 shows three vent openings 26, 34, and 54 with attached vent conduits and vent valves, it is understood that the number may vary considerably and that in the actual embodiment of the invention there may be many vent openings with attached vent conduits either from the lower or the upper portion of the chimney member.

FIG. 4 shows the arrangement wherein the chimney member includes an enlarged cylindrical portion 60 at the bottom of chimney member 20. The enlarged cylindrical portion 60 is employed when it is necessary to encompass wellhead equipment or the like in the same manner that the frustoconical arrangement of FIG. 2 provides an enlarged bottom area.

Figure 5:
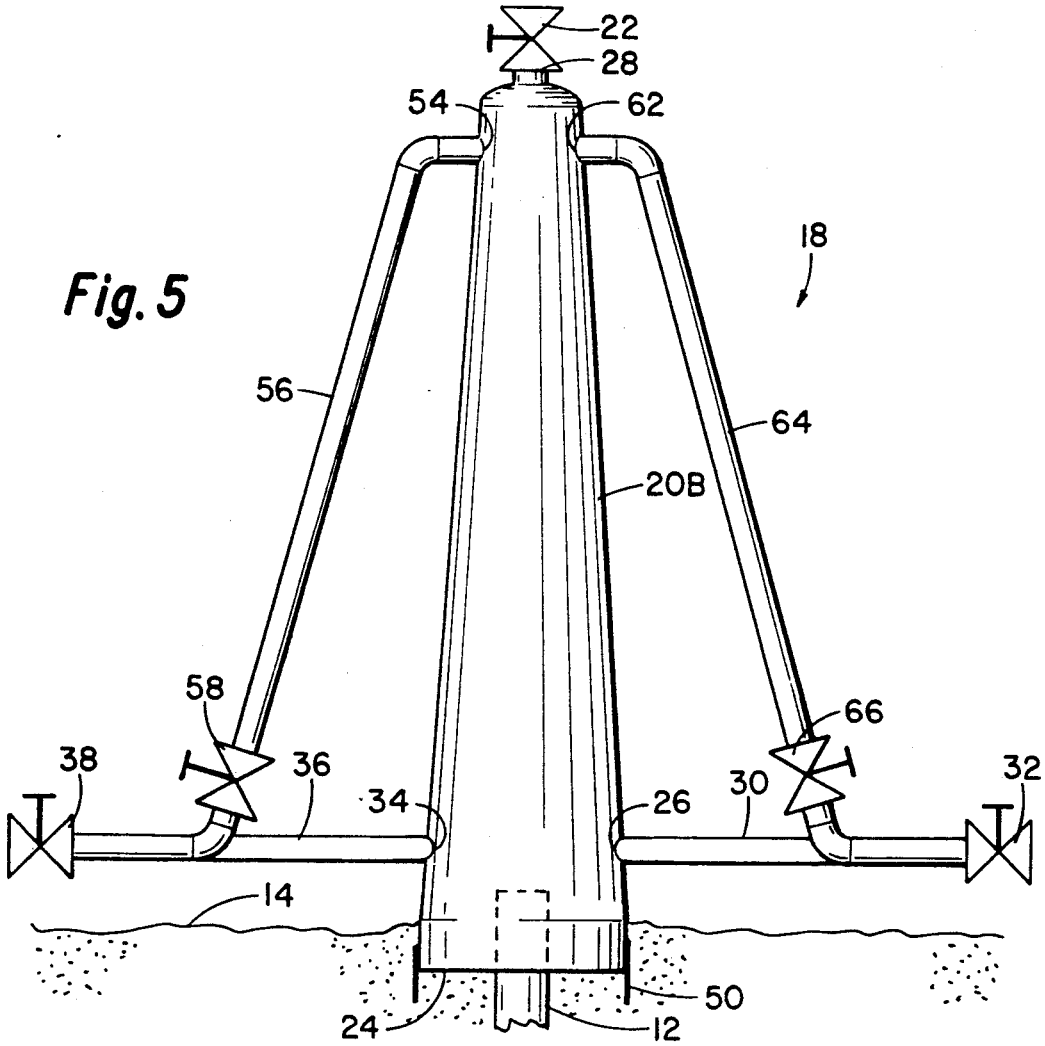
FIG. 5 is an additional alternate embodiment wherein the chimney is frustoconical and wherein vent openings are provided adjacent the top and bottom of the chimney with vent conduits extending from the top portion of the chimney as well as the lower portion of the chimney.

FIG. 5 shows an embodiment that is a combination of the features of the embodiment of FIG. 2, that is, employing a frustoconical chimney member 20B wherein the degree of taper is less, illustrating the fact that the exterior configuration of the chimney member 20B can vary considerably. In addition, FIG. 5 shows the combination of the use of the upper and lower vent openings in the manner described with reference to FIG. 4 but wherein vent valve 58, at the lower end at the downwardly inclined third vent conduit 56, communicates with vent conduit 36. In like manner, a fourth vent opening 62 has a fourth vent conduit 64 attached to it and a fourth vent valve 66 connected to horizontal vent conduit 30. This illustrates the fact that the various piping and valving combinations may be arranged for conducting escaping oil and/or gas from within chimney member 20 to a safe distance away from the well.

Figure 6:
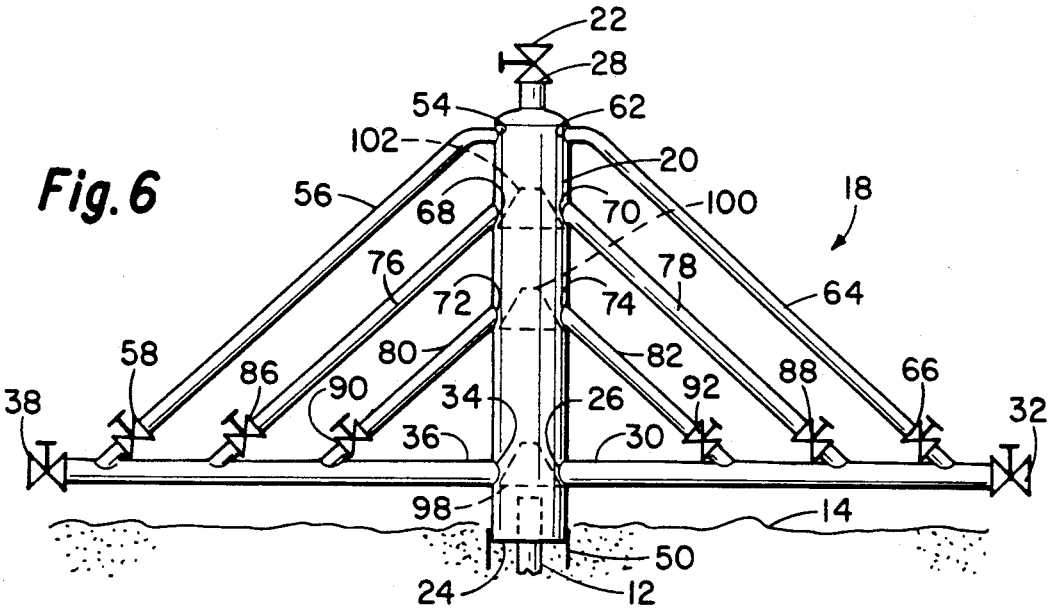
FIG. 6 is still an additional alternate embodiment wherein the chimney is cylindrical and wherein a plurality of vent conduits are employed at various elevational positions of the chimney and the vent conduits communicate with laterally extending vent conduits adjacent the earth's surface.

FIG. 6 shows still a different embodiment wherein there are additional vent openings 68 and 70 at an intermediate location and below that vent openings 72 and 74. Each of the vent openings 68, 70, 72, and 74 is connected to the horizontal vent conduits 30 and 36 by downwardly inclined conduits 76, 78, 80, and 82 and controlled by four additional vent valves 86, 88, 90, and 92. FIG. 6 is illustrative of the fact that various combinations of vent openings, vent conduits, and vent valves may be employed to provide access for the flow of unignited oil and/or gas from the interior of the chimney member to a safe distance away from the well.

In all of the embodiments illustrated the vent pipes end with valves, such as horizontal vent pipes 30 and 36 end with the valves 32 and 38, by which the vent pipes are opened and closed. While not shown, it can be seen that additional piping could be attached to valves 32 and 36 so as to conduct the oil and/or gas escaping from the well further away from the well location if necessary. Such connection can be with flexible piping if desired.

FIG. 2 shows an inverted funnel shaped baffle 94 affixed to the interior surface of chimney member 20A. Baffle lower edge 94A is welded to the chimney member interior wall below vent openings 26 and 34. The baffle top 94B is open and is of internal diameter at least as great and preferably greater than the internal diameter of casing 12 and the internal diameter of the chimney member top opening and the passageway through valve 22. Baffle 94 provides an internal circumferential reservoir 96 within chimney member 20A.

Baffle 94 serves to deflect oil and/or gas discharged from casing 12 and direct it through top opening 28 and valve 22 when apparatus 18 is set down over casing 12. When top valve 22 is closed, escaping oil is captured in internal reservoir 96 and can be drained away through vent conduits 30 and 36. Reservoir 96 may be filled with water, thereby also filling vent conduits 30 and 36 with water (with vent valves 32 and 38 closed) prior to setting apparatus 18 over casing 12. The additional water will add substantial weight to apparatus 18 and help hold it down in better sealed contact with the earth's surface 14 against the pressure of oil and/or gas escaping from casing 12.

FIG. 6 shows the use of three inverted funnel shaped baffles 98, 100, and 102. The bottom of baffle 98 is below vent openings 26 and 34 as previously described with reference to FIG. 2. The bottom of baffle 100 is below vent openings 72 and 74 and the bottom of baffle 102 is below vent openings 68 and 70. Baffles 98, 100, and 102 serve the same purpose as previously described for baffle 94 in FIG. 2. The top opening in each of baffles 98, 100, and 102 is as large as, and preferably larger, than, the internal diameter of casing 12 and the opening in chimney member top 28 and valve 22.

The various embodiments of FIGS. 1 through 6 are intended to illustrate the fact that the actual physical arrangement of the chimney structure can change considerably while maintaining the concept of the invention.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. An apparatus for use in extinguishing a burning well which produces hydrocarbons in which at least a portion of the well through which ignited hydrocarbons are escaping is at or above the earth's surface, the apparatus comprising:

an elongated generally vertical chimney member having a top end and a bottom end and a sidewall, the sidewall having a plurality of vertically spaced apart vent openings therein;

a top valve means for selectably opening and closing said chimney member top end;

a vent conduit for each said vent opening, each vent conduit having an inlet end and an outlet end and having the inlet end in communication with a respective said chimney member vent opening, the vent conduit communicating with a lowermost of said vent openings being generally horizontal and said vent conduits communicating with said vent openings above said lowermost vent opening being inclined downwardly and communicating with said generally horizontal vent conduit; and a vent valve means connected in series with said horizontal vent conduit for selectable opening and closing said generally horizontal vent conduit, said chimney member bottom end being of sufficient size to permit said chimney member to be set down vertically over said burning well to cause said hydrocarbons to pass upwardly therethrough and out through said top valve means whereby combustion of said hydrocarbons takes place above said top valve means and whereby said vent valve means may be opened to permit hydrocarbons to escape in an unignited condition from within said chimney member through each said vent conduits, after which said top valve means may be closed to extinguish the combustion of said hydrocarbons.

2. An apparatus for extinguishing the burning well according to claim 1 further including a vent valve means in series with each said vent conduits.

3. An apparatus for extinguishing the burning well according to claim 1 wherein said chimney bottom end is of larger cross-sectional area than said chimney top end.

4. An apparatus for extinguishing the burning well according to claim 1 further including:

earth penetrating means at said chimney member bottom end for penetrating the earth's surface.

5. An apparatus for extinguishing the burning well according to claim 4 wherein said earth penetrating means is a circumferential skirt means attached to said chimney member and extending past said bottom end thereof.

6. An apparatus for extinguishing the burning well according to claim 1 further including means for attaching a boom member to said chimney member.

7. An apparatus for extinguishing the burning well according to claim 1 wherein said chimney member sidewall is of generally frustoconical configuration, said bottom end being of greater diameter than said top end.

8. An apparatus for extinguishing the burning well according to claim 7 wherein said chimney member sidewall is further defined by a cylindrical portion extending form said frustoconical sidewall at the bottom end thereof.

* * * * *